US009067747B2

(12) United States Patent
Kawashima

(10) Patent No.: US 9,067,747 B2
(45) Date of Patent: Jun. 30, 2015

(54) SHEET FEEDING APPARATUS AND IMAGE FORMING APPARATUS INCLUDING SAME

(71) Applicant: KYOCERA Document Solutions Inc., Osaka-shi, Osaka (JP)

(72) Inventor: Tetsuro Kawashima, Osaka (JP)

(73) Assignee: Kyocera Document Solutions Inc. (JP)

( * ) Notice: Subject to any disclaimer, the term of this patent is extended or adjusted under 35 U.S.C. 154(b) by 0 days.

(21) Appl. No.: 14/253,280

(22) Filed: Apr. 15, 2014

(65) Prior Publication Data

US 2014/0306397 A1 Oct. 16, 2014

(30) Foreign Application Priority Data

Apr. 15, 2013 (JP) ..... 2013-084649

(51) Int. Cl.

| | |
|---|---|
| ***B65H 1/08*** | (2006.01) |
| ***B65H 1/28*** | (2006.01) |
| ***B65H 5/00*** | (2006.01) |
| ***B65H 1/04*** | (2006.01) |
| ***B65H 3/06*** | (2006.01) |

(52) U.S. Cl.

CPC .. *B65H 1/08* (2013.01); *B65H 1/28* (2013.01); *B65H 5/00* (2013.01); *B65H 1/04* (2013.01); *B65H 3/0607* (2013.01); *B65H 2402/441* (2013.01); *B65H 2403/5331* (2013.01); *B65H 2801/06* (2013.01); *B65H 2405/324* (2013.01); *B65H 2405/111646* (2013.01)

(58) Field of Classification Search

CPC ..... B65H 2407/21; B65H 2405/324; G03G 15/6514; G03G 2215/00392

USPC ..... 271/9.09, 162; 399/392

See application file for complete search history.

(56) References Cited

U.S. PATENT DOCUMENTS

| | | | | |
|---|---|---|---|---|
| 5,573,235 | A * | 11/1996 | Asai | 271/121 |
| 7,036,813 | B2 * | 5/2006 | Asada | 271/117 |
| 7,677,556 | B2 * | 3/2010 | Murayama et al. | 271/162 |
| 8,033,540 | B2 * | 10/2011 | Lee et al. | 271/9.09 |
| 8,820,733 | B2 * | 9/2014 | Arimura | 271/18.1 |
| 2009/0267283 | A1 * | 10/2009 | Mizuguchi | 271/3.14 |
| 2011/0227277 | A1 | 9/2011 | Wada et al. | |
| 2013/0011174 | A1 * | 1/2013 | Lee et al. | 399/381 |
| 2014/0186083 | A1 | 7/2014 | Lee et al. | |
| 2014/0241775 | A1 | 8/2014 | Kawashima | |

FOREIGN PATENT DOCUMENTS

JP 2007-199490 8/2007

OTHER PUBLICATIONS

European Patent Appl. No. 14 001 356.6—Search Report issued on Dec. 4, 2014.

* cited by examiner

*Primary Examiner* — Jeremy R Severson

(74) *Attorney, Agent, or Firm* — Gerald E. Hespos; Michael J. Porco; Matthew T. Hespos

(57) ABSTRACT

A sheet feeding apparatus includes a sheet tray, a sheet feeding roller and a pair of link members. The sheet tray constitutes a loading surface. The sheet tray includes a tray main body and a lifting plate. The tray main body is openable and closable with respect to the wall portion. The lifting plate has a pair of first fulcrum portions disposed upstream of the sheet feeding roller. The downstream side of the lifting plate is rotationally movable up and down around the first fulcrum portions. The tray main body has a pair of second fulcrum portions. The second fulcrum portions are configured to be a pivot point for the opening and closing operation of the tray main body. Each of the pair of link members is coupled to the first fulcrum portion and to the wall portion.

12 Claims, 11 Drawing Sheets

SHEET FEEDING APPARATUS AND IMAGE FORMING APPARATUS INCLUDING SAME

The application is based on Japanese Patent Application No. 2013-084649 filed to Japan Patent Office on Apr. 15, 2013, the contents of which are incorporated herein by reference.

BACKGROUND

The disclosure relates to a sheet feeding apparatus that feeds sheets and an image forming apparatus including the sheet feeding apparatus.

As the sheet feeding apparatus that feeds sheets, a manual sheet feeding section is conventionally known which feeds sheets to an apparatus main body of the image forming apparatus. The manual sheet feeding section includes a manual sheet feeding tray installed therein so as to be openable with respect to an apparatus main body of the image forming apparatus. When the manual sheet feeding tray is opened with respect to the apparatus main body, sheets are placed on the manual sheet feeding tray. Each of the sheets is loaded into the apparatus main body by a sheet feeding roller, and an image is formed on the sheet.

The manual sheet feeding tray includes a sheet tray on which sheets are placed and which is opened with respect to the apparatus main body, and a lifting plate disposed on a leading end side of the sheet tray. A leading end side of the lifting plate moves up and down using, as a fulcrum, an axis of rotation disposed near a fulcrum portion for opening and closing of the sheet tray. Thus, the leading end side of the sheet comes into abutting contact with the sheet feeding roller.

An object of the disclosure is to stabilize orientation of sheets in abutting contact with the sheet feeding roller even with a change in the number of sheets placed on the sheet tray.

SUMMARY

A sheet feeding apparatus according to an aspect of the present disclosure includes is arranged to an apparatus main body which has a wall portion and a sheet conveying path. The sheet feeding apparatus includes a sheet tray, a sheet feeding roller and a pair of link members. The sheet tray is installed on the wall portion and constitutes a loading surface on which a sheet to be conveyed in a predetermined conveying direction is placed. The sheet conveying path extends from the sheet tray into the apparatus main body and a sheet is conveyed through the sheet conveying path. The sheet feeding roller is disposed opposite the loading surface on a downstream side of the sheet tray in the conveying direction. The sheet feeding roller is rotationally driven to feed the sheet to the sheet conveying path. The pair of link members has a first end portion and a second end portion each. The sheet tray includes a tray main body and a lifting plate. The tray main body includes the loading surface and is openable and closable with respect to the wall portion. The lifting plate has a pair of first fulcrum portions disposed upstream of the sheet feeding roller in the conveying direction at respective opposite end portions of the lifting plate in a sheet width direction intersecting with the conveying direction. The lifting plate has an upper surface constituting a downstream side, in the conveying direction, of the loading surface. The downstream side of the lifting plate is rotationally movable up and down around the first fulcrum portions, thereby bringing the sheet into contact with the sheet feeding roller. The tray main body has a pair of second fulcrum portions disposed on a downstream side of the tray main body in the conveying direction at respective opposite ends of the tray main body in the sheet width direction. The second fulcrum portions are rotatably supported by the wall portion and configured to be a pivot point for the opening and closing operation of the tray main body. Each of the pair of link members is coupled to the first fulcrum portion at the first end portion and to the wall portion at the second end portion, thereby regulating an opening angle of the tray main body around the second fulcrum portions.

Furthermore, an image forming apparatus according to another aspect of the present disclosure includes the apparatus main body which has the wall portion, the sheet feeding apparatus and an image forming section. The sheet from the sheet feeding apparatus is conveyed to the image forming section which forms an image on the sheet.

DETAILED DESCRIPTION

Figure 1:
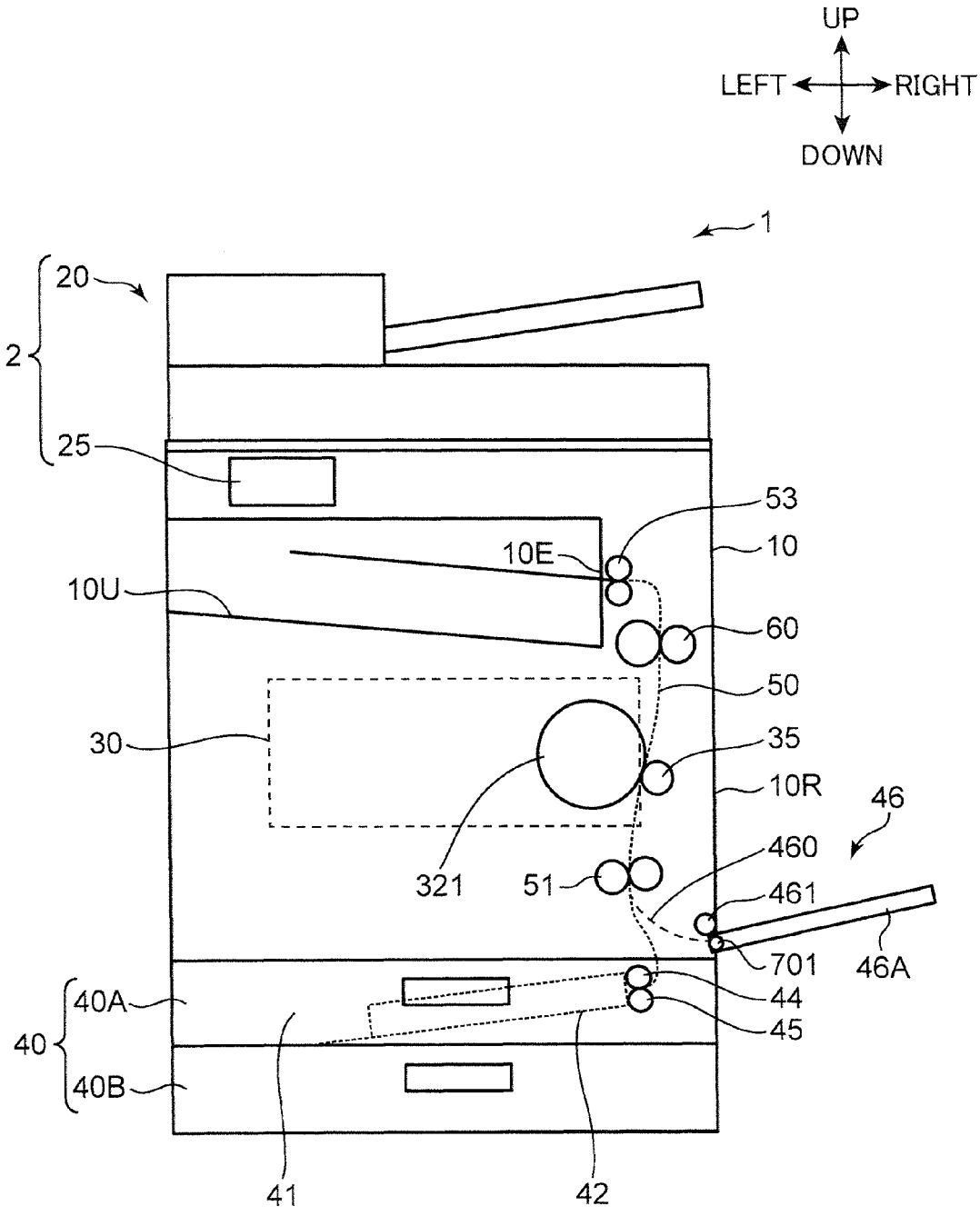
FIG. 1 is a schematic cross-sectional view showing the structure of an image forming apparatus according to an embodiment of the disclosure.

An embodiment of the disclosure will be described below in detail based on the drawings. FIG. 1 is a schematic cross-sectional view showing the internal structure of an image forming apparatus 1 according to an embodiment of the disclosure. A multifunction printer with a printer function and a copying function is illustrated herein as the image forming apparatus 1. However, the image forming apparatus may be a printer, a copier, a facsimile machine, or the like.

Description of the Image Forming Apparatus

The image forming apparatus 1 includes an apparatus main body 10 with a rectangular parallelepiped-like case structure and an automatic document feeder 20 disposed on the apparatus main body 10. The apparatus main body 10 contains a reading unit 25 that optically reads a document to be copied, an image forming section 30 that forms a toner image on a sheet, a fixing section 60 that fixes the toner image to the sheet, a sheet feeding section 40 that stores standard-size sheets to be conveyed to the image forming section 30, and a conveying path 50 through which the standard-size sheet is conveyed from the sheet feeding section 40 or a manual sheet feeding section 46 to a sheet discharge port 10E via the image forming section 30 and the fixing section 60. The apparatus main body 10 includes aright side surface 10R (wall portion). The right side surface 10R is a right sidewall of the apparatus main body 10.

The automatic document feeder (ADF) 20 is rotationally movably mounted on an upper surface of the apparatus main body 10. The ADF 20 automatically feeds a document sheet to be copied toward a predetermined document reading position in the apparatus main body 10. On the other hand, when a user manually places a document sheet at the predetermined document reading position, the ADF 20 is opened upward.

The apparatus main body 10 includes contact glass (not shown in the drawings) disposed on the upper surface of the apparatus main body 10 to allow reading of a document sheet automatically fed from the ADF 20 or a manually placed document sheet. The reading unit 25 optically reads an image from the document sheet through the contact glass. The automatic document feeder (ADF) 20 and the reading unit 25 provide an image reading apparatus 2.

The image forming section 30 forms an image on a sheet by generating and transferring a toner image onto the sheet based on a well-known electrophotographic scheme. In other embodiments, another image forming scheme such as an ink jet scheme may be adopted.

The image forming section 30 includes a photosensitive drum 321, and a charger, an exposure device, a developing device, and a cleaning device (not shown in the drawings) which are disposed around the photosensitive drum 321.

The photosensitive drum 321 rotates around the axis thereof and has an electrostatic latent image and a toner image formed on a peripheral surface thereof. The charger evenly charges a surface of the photosensitive drum 321. The exposure device has a laser light source and optical devices such as a mirror and a lens and irradiates the peripheral surface of the photosensitive drum 321 with light based on image data in a document image to form an electrostatic latent image. To develop the electrostatic latent image on the photosensitive drum 321, the developing device supplies toner to the peripheral surface of the photosensitive drum 321. The cleaning device cleans the peripheral surface of the photosensitive drum 321 after a toner image has been transferred.

A transfer roller 35 is disposed opposite the photosensitive drum 321. At a transfer nip portion between the photosensitive drum 321 and the transfer roller 35, a toner image on the photosensitive drum 321 is transferred to a sheet. A secondary transfer bias potential with a polarity opposite to the polarity of the toner image is applied to the transfer roller 35.

The sheet feeding section 40 includes a first sheet feeding cassette 40A and a second sheet feeding cassette 40B forming two stages and containing standard-sizes sheets P included in sheets on which an image forming process is executed. The sheet feeding cassettes can be withdrawn from the front of the apparatus main body 10 toward a user.

The first sheet feeding cassette 40A includes a sheet housing section 41 that houses a sheet bundle including stacked standard-size sheets P and a lift plate 42 that lifts the sheet bundle up for sheet feeding. A pickup roller (not shown in the drawings) and a roller pair of a sheet feeding roller 44 and a retard roller 45 are disposed in an upper portion of the sheet feeding cassette 40A on a right end side thereof. The pickup roller and the sheet feeding roller 44 are activated to take out the uppermost sheet P of the sheet bundle in the sheet feeding cassette 40A and carries the uppermost sheet P to an upper end of the conveying path 50. The second sheet feeding cassette 40B has a configuration similar to the configuration of the first sheet feeding cassette 40A.

The manual sheet feeding section 46 (sheet feeding apparatus) is disposed on the right side surface 10R of the apparatus main body 10. The manual sheet feeding section 46 conveys a sheet toward the image forming section 30. The manual sheet feeding section 46 includes a manual sheet feeding tray 46A (sheet tray) for manual sheet feeding and a sheet feeding roller 461. The manual sheet feeding tray 46A is installed on the right side surface 10R of the apparatus main body 10 and provides a loading surface on which sheets to be conveyed in the predetermined conveying direction. A downstream side, in the conveying direction, of the loading surface is provided by a lifting plate 71 described below. Furthermore, the manual sheet feeding tray 46A is attached so as to be openable and closable with respect to the apparatus main body 10 around a fulcrum portion 701 disposed at a lower end of the manual sheet feeding tray 46A. When manually feeding sheets, the user opens the manual sheet feeding tray 46A and places the sheets on the manual sheet feeding tray 46A, as shown in the drawings. The sheet feeding roller 461 is disposed opposite the loading surface of the manual sheet feeding tray 46A on a downstream side of the manual sheet feeding tray 46A in the conveying direction. The sheet feeding roller 461 is rotationally driven by a driving mechanism (not shown in the drawings) to feed the sheet out to a manual feeding sheet conveying path 460. The manual feeding sheet conveying path 460 extends from the manual sheet feeding tray 46A into the apparatus main body 10. Along the manual feeding sheet conveying path 460, the sheet is conveyed in the predetermined conveying direction. Moreover, the sheet is carried from the manual feeding sheet conveying path 460 to the conveying path 50.

The conveying path 50 extends from the sheet feeding section 40 through the image forming section 30 and the fixing section 60 to the sheet discharge port 10E. In the conveying path 50, a pair of registration rollers 51 is disposed upstream of the transfer nip portion. The sheet is temporarily stopped by the stopped pair of registration rollers 51, and skew correction is performed on the sheet. Subsequently, at a predetermined timing for image transfer, the pair of registration rollers 51 is rotationally driven by a driving section (not shown in the drawings) to feed the sheet out to the transfer nip portion.

A sheet discharge roller 53 is disposed at the most downstream end of the conveying path 50. The sheet discharge roller 53 discharges the sheet P through the sheet discharge port 10E. The sheet P discharged through the sheet discharge port 10E is then discharged to a sheet discharge section 10U, where the sheet is stacked on other sheets.

The fixing section 60 executes a fixing process of fixing a toner image to the sheet. A pressurization roller is in pressure contact with a fixing roller (not shown in the drawings) to form a fixing nip portion.

Sheet Feeding Apparatus

Figure 2:
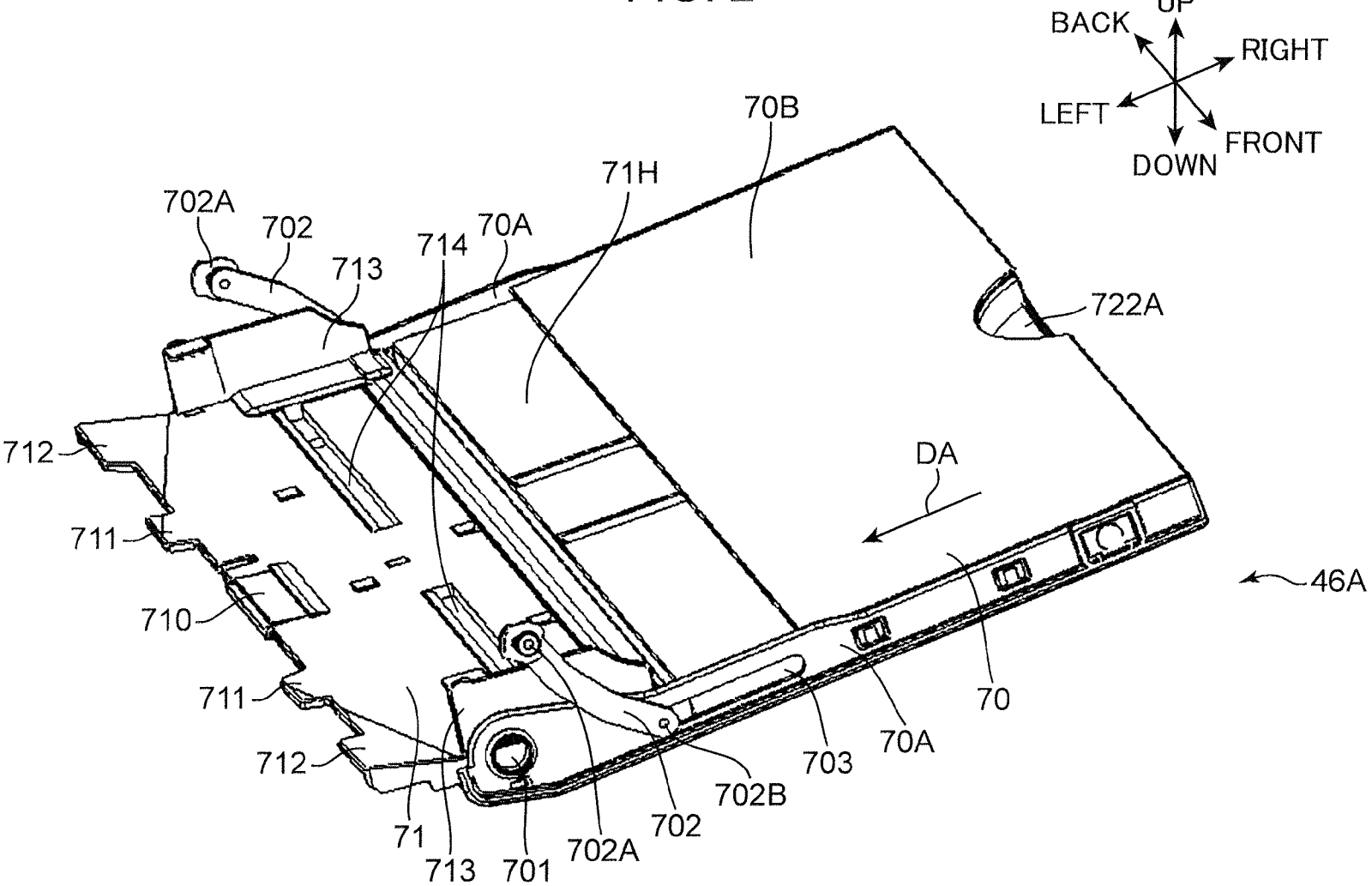
FIG. 2 is a perspective view of a manual sheet feeding tray according to the embodiment of the disclosure.
Figure 3:
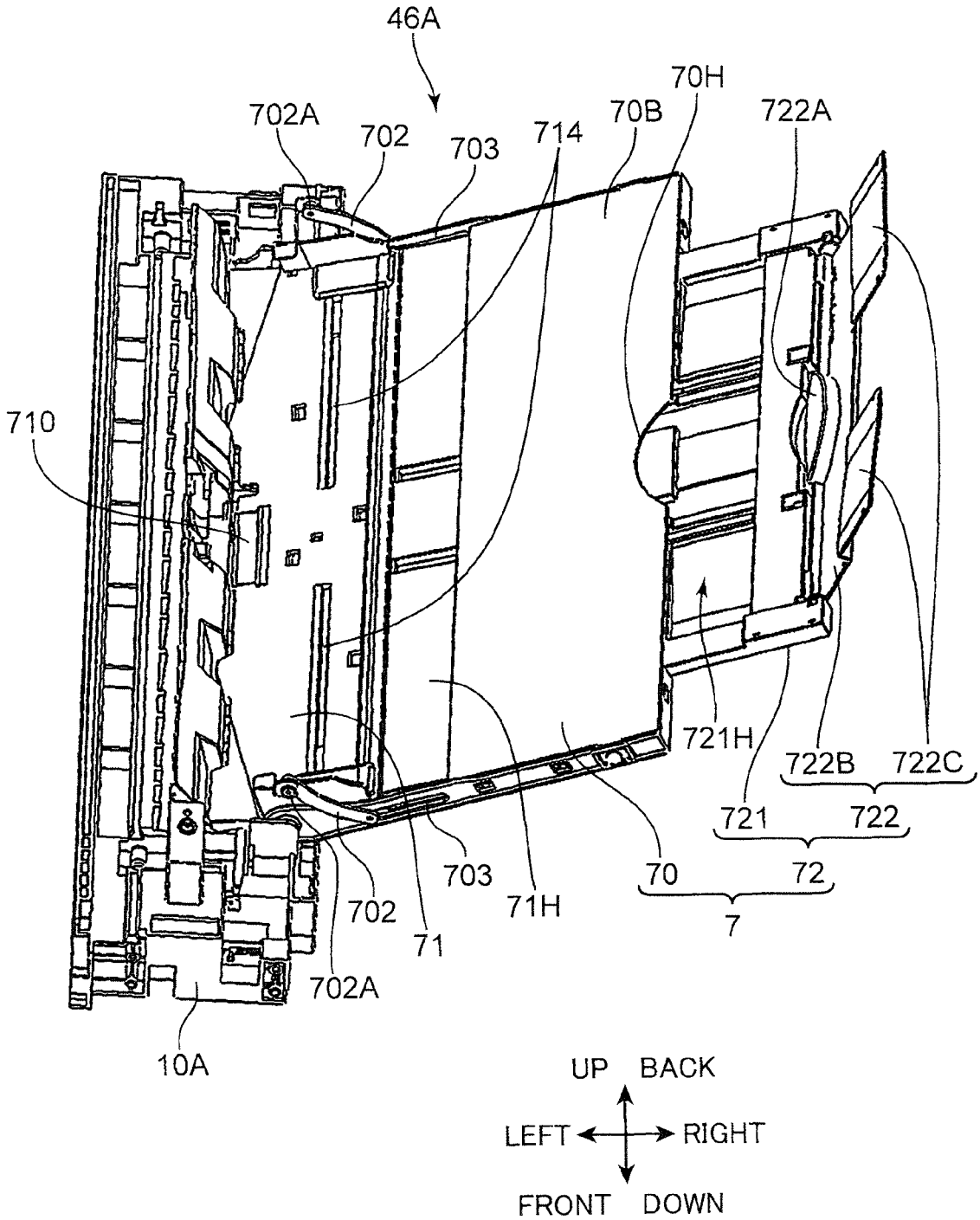
FIG. 3 is a perspective view of the manual sheet feeding section according to the embodiment of the disclosure.
Figure 4:
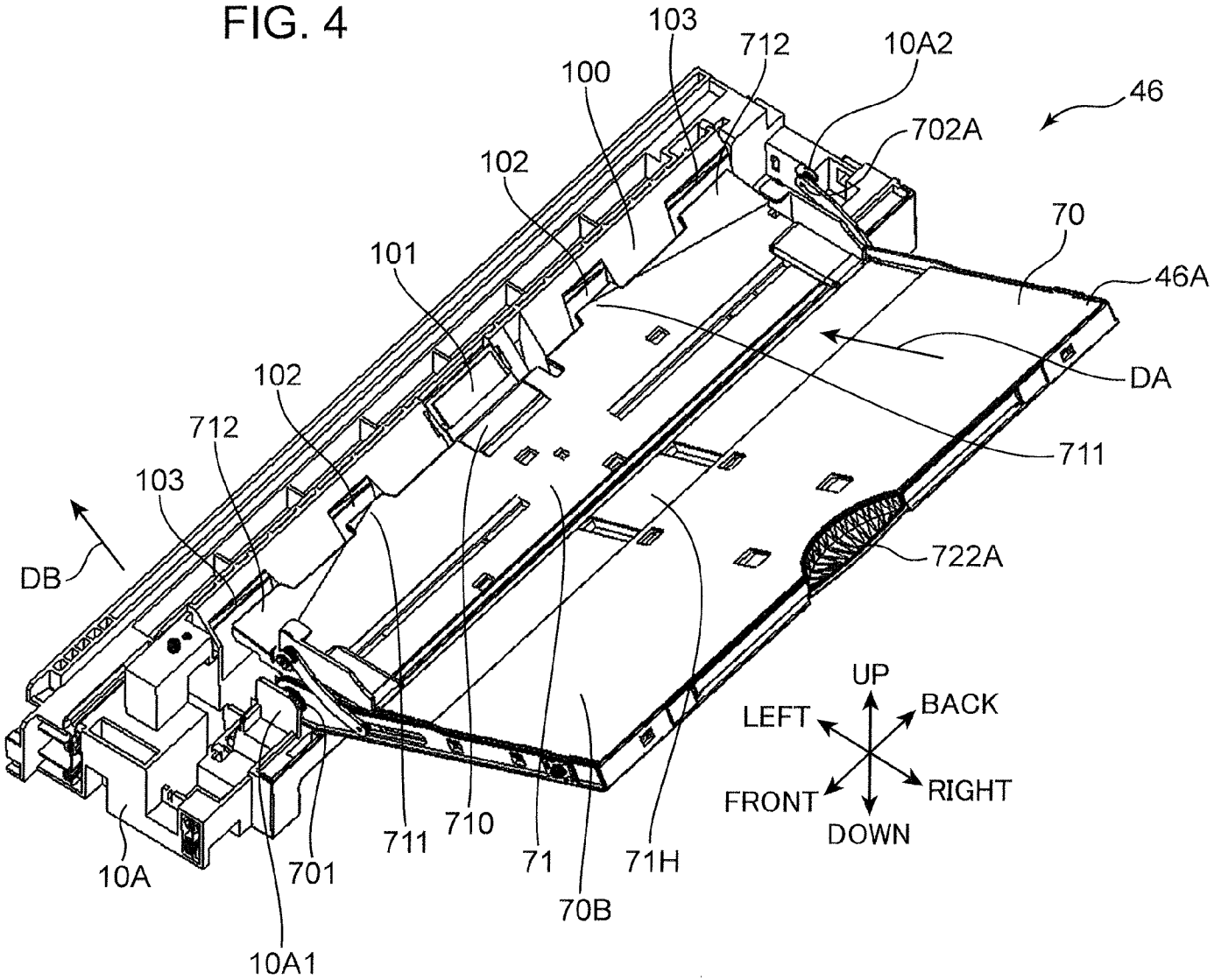
FIG. 4 is a perspective view of the manual sheet feeding section according to the embodiment of the disclosure.
Figure 5:
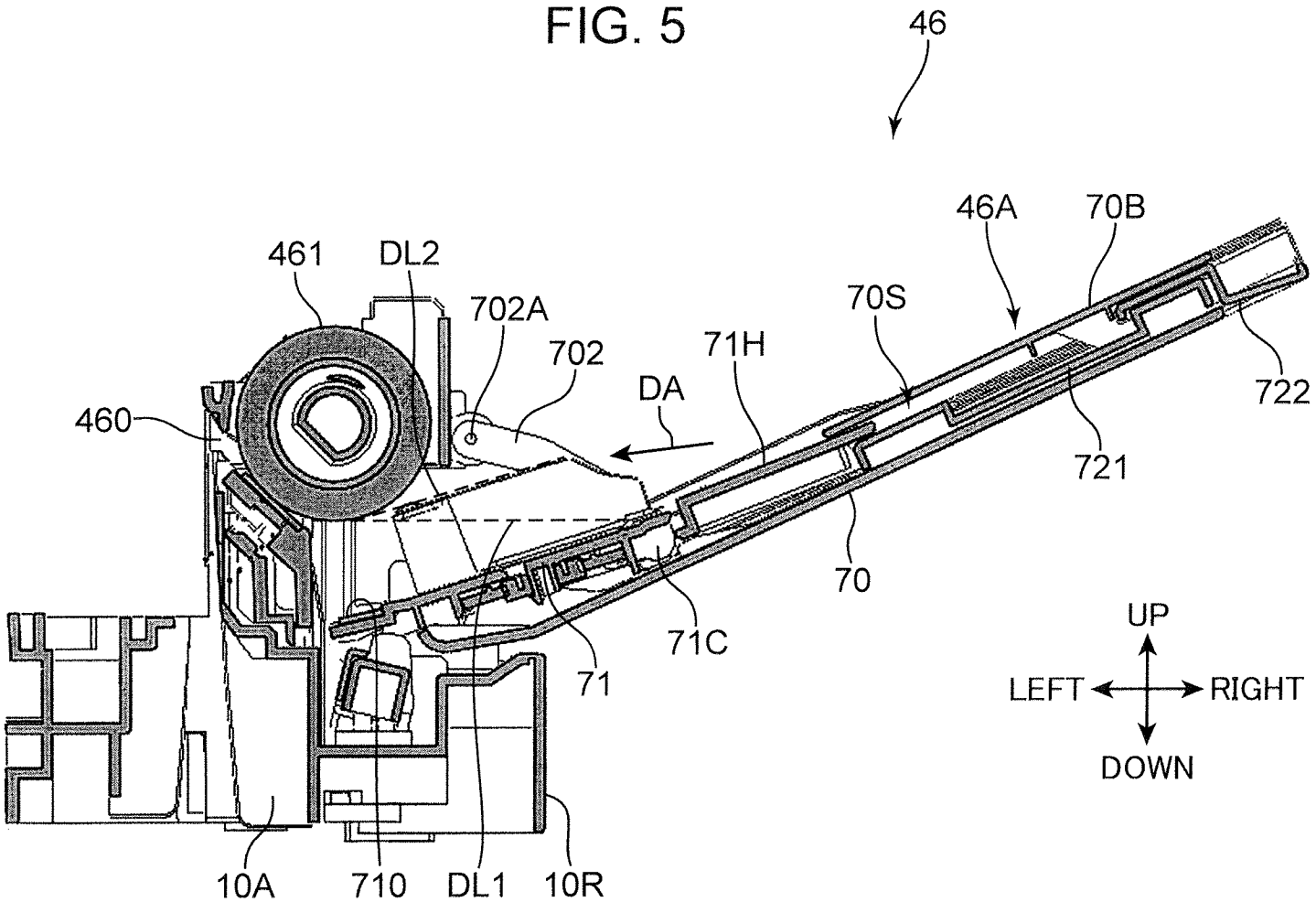
FIG. 5 is a cross-sectional view of the manual sheet feeding section according to the embodiment of the disclosure.
Figure 6:
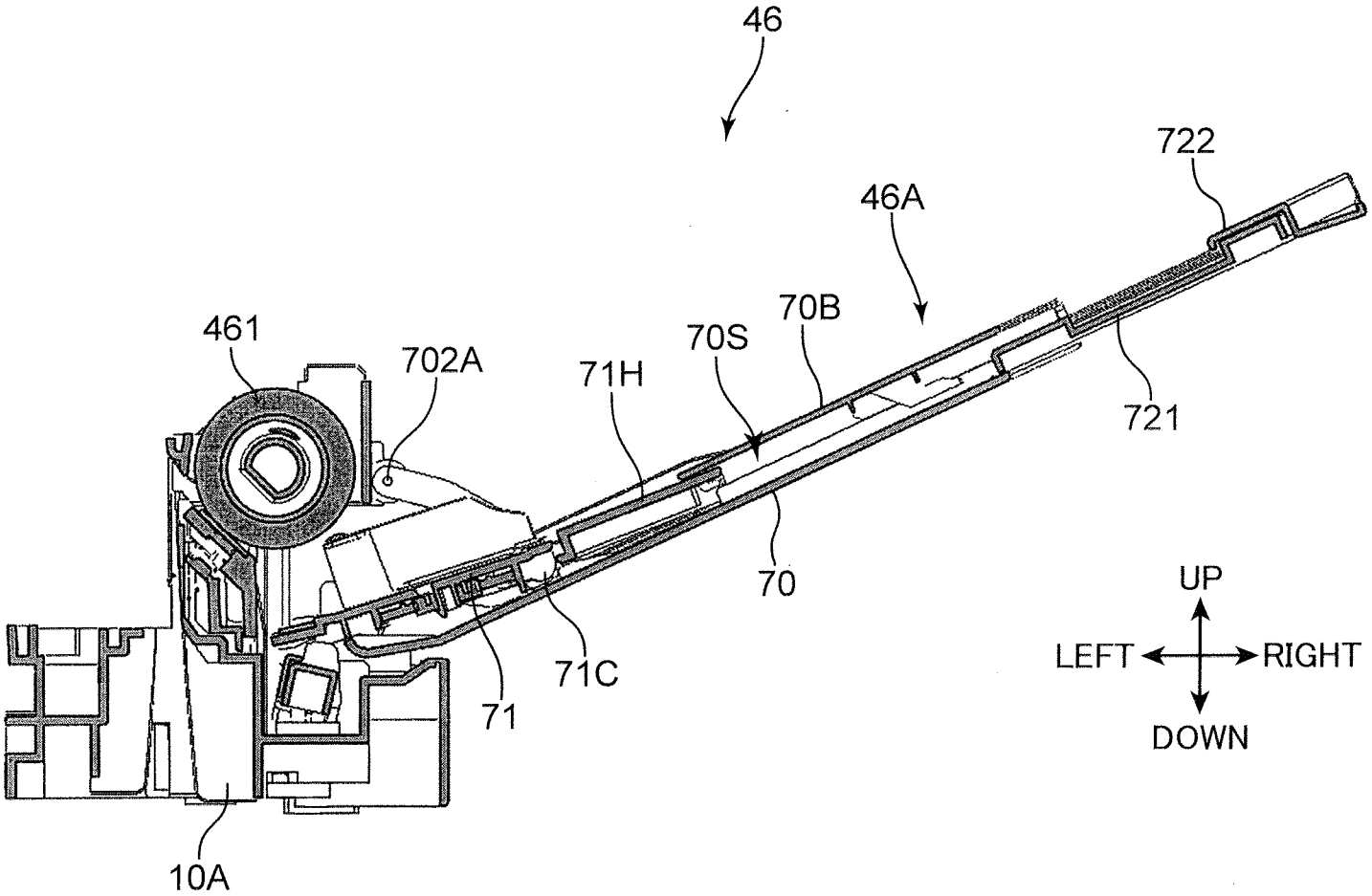
FIG. 6 is a cross-sectional view showing that an auxiliary tray has been withdrawn from the manual sheet feeding section according to the embodiment of the disclosure.
Figure 7:
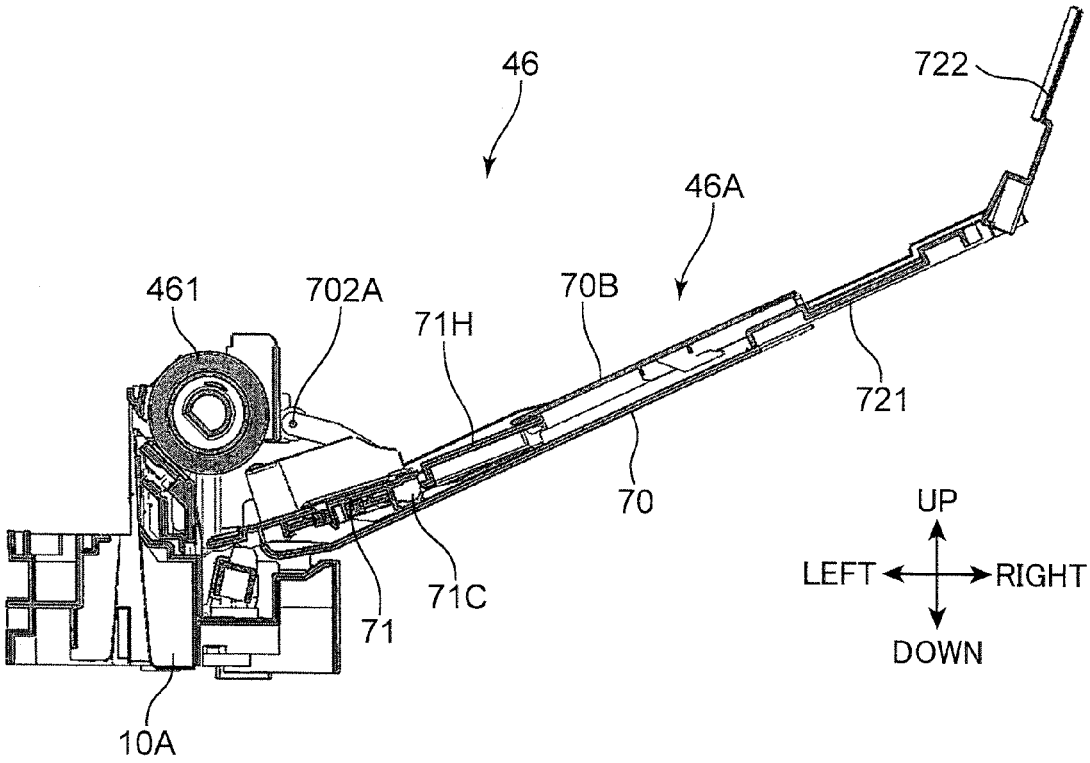
FIG. 7 is a cross-sectional view showing that a second auxiliary tray of the auxiliary tray of the manual sheet feeding section according to the embodiment of the disclosure is open.

Now, a configuration of the manual sheet feeding tray 46A (sheet tray) of the manual sheet feeding section 46 (sheet feeding apparatus) according to the present embodiment will be described with reference to FIG. 2 to FIG. 7 in addition to FIG. 1. FIG. 2 is a perspective view of the manual sheet feeding tray 46A according to the present embodiment. Furthermore, FIG. 3 and FIG. 4 are perspective views of the manual sheet feeding section 46 including the manual sheet feeding tray 46A. Moreover, FIG. 5 to FIG. 7 are cross-sectional views of the manual sheet feeding section 46. FIG. 2, FIG. 4, and FIG. 5 show that an auxiliary tray 72 is housed in a tray main body 70. FIG. 6 shows that the auxiliary tray 72 has been withdrawn from the tray main body 70. FIG. 3 and FIG. 7 show that a second auxiliary tray 722 of the auxiliary tray 72 is open with respect to a first auxiliary tray 721.

The manual sheet feeding tray 46A includes the tray main body 70, the auxiliary tray 72, and the lifting plate 71. The tray main body 70 and the auxiliary tray 72 provide a tray portion 7 of the manual sheet feeding tray 46A (see FIG. 3). The tray portion 7 includes a sheet loading surface (loading surface) at an upper surface thereof on which sheets with a predetermined width in a front-back direction are placed. The tray main body 70 is a main body portion of the manual sheet feeding tray 46A including the loading surface. The tray main body 70 is a plate-like member shaped approximately like a rectangle with sides extending in a front-back direction and a lateral direction. The tray main body 70 is openable and closable with respect to the right side surface 10R of the apparatus main body 10. The tray main body 70 includes a pair of sidewalls 70A and a tray upper surface portion 70B. The sidewalls 70A are erected at opposite ends of the tray main body 70 in a sheet width direction (front-back direction) so as to extend along a sheet conveying direction (shown by arrow DA in FIG. 2 and FIG. 4). The tray upper surface portion 70B is an upper surface portion located on an upstream side, in the conveying direction, of the tray main body 70 and forms a part of the loading surface. The tray main body 70 further includes fulcrum portions 701 (second fulcrum portions), a pair of latching sections 702 (link members), and guide grooves 703 (openings).

The fulcrum portions 701 are disposed on a downstream side of the tray main body 70 in the conveying direction, at opposite end portions of the tray main body 70 in the sheet width direction, which intersects with the conveying direction. The fulcrum portions 701 are axially supported in a rotatable manner by the right side surface 10R. Specifically, the fulcrum portions 701 are axially supported by a loading section 10A described below and disposed on the right side surface 10R. According to the present embodiment, the fulcrum portions 701 are hole portions formed at downstream side end portions, in the conveying direction, of the pair of sidewalls 70A. The pair of fulcrum portions 701 serves as a fulcrum for rotational movement (opening and closing operations) of the manual sheet feeding tray 46A with respect to the apparatus main body 10. A shaft portion (not shown in the drawings) disposed on the right side surface 10R of the apparatus main body 10 is inserted through the fulcrum portions 701.

The latching sections 702 (FIG. 2) are thin-plate-like arm members installed on the respective sidewalls 70A. The latching sections 702 regulate the opening angle of the manual sheet feeding tray 46A around the fulcrum portions 701 with respect to the apparatus main body 10. Each of the latching sections 702 includes a latching fulcrum portion 702A (a third fulcrum portion) and a slide fulcrum portion 702B (a fourth fulcrum portion). The latching fulcrum portion 702A is disposed at an end portion (a second end portion) of the latching section 702. The latching fulcrum portion 702A is axially supported by (coupled to) the right side surface 10R above the fulcrum portion 701. Specifically, the latching fulcrum portion 702A is axially supported in a rotatable manner by the loading section 10A. The slide fulcrum portion 702B is disposed at an end portion (a first end portion) of the latching section 702. The slide fulcrum portions 702B axially support, opposite the latching fulcrum portion 702A, respective lifting fulcrum portions 71C described below via the corresponding guide grooves 703 described below so that the lifting fulcrum portions 71C are rotatable. The slide fulcrum portion 702B is slidable along the guide groove 703. The slide fulcrumportion 702B is a projecting portion inserted through the guide groove 703. Furthermore, the slide fulcrum portion 702B is coupled to the lifting fulcrum portion 71C described below.

The guide groove 703 of each of the pair of sidewalls 70A is a slot-like opening formed opposite the sheet end surface of sheets placed on the manual sheet feeding tray 46A and along the sheet conveying direction. The slide fulcrum portion 702B moves along the guide groove 703 to guide opening and closing operations of the manual sheet feeding tray 46A with respect to the apparatus main body 10. Furthermore, the slide fulcrum portion 702B is latched at a left end portion of the guide groove 703 to regulate the opening angle of the manual sheet feeding tray 46A.

The configuration of the fulcrum portion 701, the latching section 702, and the guide groove 703 allows the slide fulcrum portion 702B to move along the guide groove 703 when the tray main body 70 is rotationally moved around the fulcrum portion 701. As a result, the manual sheet feeding tray 46A is opened with respect to the right side surface 10R, and sheets can be placed on the loading surface of the manual sheet feeding tray 46A.

The lifting plate 71 includes a plate-like member disposed on a downstream side, in the conveying direction (the direction of arrow DA in FIG. 2), of the sheet loading surface of the tray main body 70. The lifting plate 71 supports sheets on an upper surface thereof. That is, the upper surface portion of the lifting plate 71 provides the downstream side, in the conveying direction, of the loading surface. A downstream side end portion, in the conveying direction, of the lifting plate 71 rotationally moves up and down with respect to the tray main body 70 by a lifting mechanism (not shown in the drawings). The lifting plate 71 includes the lifting fulcrum portions 71C (FIG. 5). The downstream side end of the lifting plate 71 moves up and down around the lifting fulcrum portions 71C. The lifting fulcrum portions 71C are disposed on the same axis as the axis of the slide fulcrum portions 702B. The lifting plate 71 and the latching sections 702 are coupled together via the lifting fulcrum portions 71C and the slide fulcrum portions 702B. The lifting plate 71 is axially supported at the lifting fulcrum portions 71C (slide fulcrum portions 702B) so as to be rotationally movable relative to the latching sections 702. The lifting mechanism (not shown in the drawings) includes a cam member (not shown in the drawings) that comes into abutting contact with the after-mentioned outer guide pieces 712 (FIG. 2) of the lifting plate 71 from below. The abutting contact of the cam member moves the lifting plate 71 up and down. In addition, a pair of the lifting fulcrum portions 71C is disposed so as to be axially supported by the tray main body 70 of the manual sheet feeding tray 46A upstream of the sheet feeding roller 461 in the conveying direction at opposite ends of the lifting plate 71 in the sheet width direction which intersects with the conveying direction.

Sheets placed on the manual sheet feeding tray 46A are brought into abutting contact with the sheet feeding roller 461 (FIG. 1) as the downstream side end portion of the lifting plate 71 elevates. The lifting plate 71 further includes a sheet feeding pad 710, inner guide pieces 711, outer guide pieces 712, cursors 713, and cursor guide grooves 714.

The sheet feeding pad 710 is disposed in a central portion of the lifting plate 71 in the sheet width direction (front-back direction) on a leading end side of the lifting plate 71 in the sheet conveying direction. The sheet feeding pad 710 is disposed opposite the sheet feeding roller 461 to prevent possible double feeding of sheets. The sheet feeding pad 710 consists of a rubber member. The inner guide pieces 711 are a pair of projecting pieces projecting from a downstream edge, in the sheet conveying direction, of the lifting plate 71 toward the sheet downstream side in the conveying direction. The inner guide pieces 711 are disposed on the opposite sides of the sheet feeding pad 710 in the sheet width direction. The outer guide pieces 712 are a pair of projecting pieces provided outside the respective inner guide pieces 711 in the sheet width direction, in other words, at the opposite end portions of the lifting plate 71, and projecting toward the sheet downstream side, in the conveying direction, of the lifting plate 71. The inner guide pieces 711 and the outer guide pieces 712 have a function to guide a sheet carried from the manual sheet feeding tray 46A.

A pair of the cursors 713 is disposed inside the pair of sidewalls 70A so as to be movable in the front-back direction with respect to the lifting plate 71. The cursors 713 regulate the widthwise position of sheets placed on the tray main body 70. Each of the cursor 713 moves, via a rack and pinion mechanism (not shown in the drawings), in the front-back direction along a cursor guide groove 714 formed on the lifting plate 71.

The auxiliary tray 72 (FIG. 3) is withdrawable rightward from the tray main body 70. Thus, the tray main body 70 includes a housing space 70S (FIG. 5 and FIG. 6) (housing portion) formed inside the tray main body 70 and defined by the tray upper surface portion 70B. The auxiliary tray 72 can be housed in the housing space 70S. A user of the manual sheet feeding tray 46A grips a gripping section 722A formed on the auxiliary tray 72 to withdraw the auxiliary tray 72 from the tray main body 70. The tray main body 70 includes a semicircular cutout portion 70H (FIG. 3) formed in association with the gripping section 722A. When the auxiliary tray 72 is withdrawn with respect to the tray main body 70, longer sheets can be placed on the manual sheet feeding tray 46A.

The auxiliary tray 72 includes the first auxiliary tray 721 and the second auxiliary tray 722. The first auxiliary tray 721 is withdrawable from the tray main body 70 in a sheet length direction and is disposed parallel to the tray main body 70. The length, in the sheet width direction, of the first auxiliary tray 721 is set smaller than the length, in the sheet width direction, of the tray main body 70. The second auxiliary tray 722 is disposed on the first auxiliary tray 721. As shown in FIG. 6 and FIG. 7, the second auxiliary tray 722 is openable with respect to the first auxiliary tray 721, and can have the state of the second auxiliary tray 722 changed between an open state (FIG. 7) where the second auxiliary tray 722 extends from the first auxiliary tray 721 in the sheet length direction and a closed state (FIG. 6) where the second auxiliary tray 722 overlaps the first auxiliary tray 721 and can be housed in the housing space 70S along with the tray main body 70.

As shown in FIG. 3, the second auxiliary tray 722 includes a plate portion 722B and an extension plate 722C. The plate portion 722B is a main body portion of the second auxiliary tray 722 and includes a plate-like member interconnected with the first auxiliary tray 721. The gripping section 722A is formed by recessing, into a semicircular shape, a central portion, in the sheet width direction, of a surface of the plate portion 722B which surface is opposite to the first auxiliary tray 721.

When the second auxiliary tray 722 is open as shown in FIG. 3, the extension plate 722C extends from the plate portion 722B along the sheet length direction. The first auxiliary tray 721 includes housing sections 721H (FIG. 3) disposed on the left of first auxiliary tray 721 and each formed by partly recessing the first auxiliary tray 721 along the front-back direction and the lateral direction. The closed extension plates 722C are housed in the respective housing sections 721H to reduce the thickness of the auxiliary tray 72 when the second auxiliary tray 722 is laid on top of the first auxiliary tray 721.

As shown in FIG. 7, when the auxiliary tray 72 is withdrawn rightward from the tray main body 70 and the second auxiliary tray 722 is opened with respect to the first auxiliary tray 721, the second auxiliary tray 722 extends generally upward at a predetermined angle to the first auxiliary tray 721. Thus, when sheets with a sheet length equal to or larger than the length of the tray main body 70 plus the length of the first auxiliary tray 721 are placed on the manual sheet feeding tray 46A, the sheet is disposed with the trailing end thereof in the sheet conveying direction bent upward. This reduces a space around the manual sheet feeding tray 46A occupied by the sheets in the direction of sheet length.

Moreover, the manual sheet feeding tray 46A includes an intermediate plate 71H (intermediate tray) (FIG. 2 and FIG. 5). The intermediate plate 71H forms a part of the loading surface between the lifting plate 71 and the tray upper surface portion 70B. When the manual sheet feeding tray 46A is closed with respect to the apparatus main body 10, the intermediate plate 71H is housed in the housing space 70S in the tray main body 70 so that the intermediate plate 71H overlaps the first auxiliary tray 721 and the tray upper surface portion 70B (see FIG. 8). On the other hand, when the manual sheet feeding tray 46A is opened with respect to the apparatus main body 10, the intermediate plate 71H is withdrawn from the housing space 70S in conjunction with the slidable movement of the lifting plate 71, as described below. As a result, the intermediate plate 71H forms a part of the loading surface of the manual sheet feeding tray 46A, as described above. The intermediate plate 71H comes into abutting contact with an upper end portion of the lifting plate 71 under the weight of the intermediate plate 71H.

As shown in FIG. 4, the manual sheet feeding section 46 further includes the loading section 10A. The loading section 10A is disposed on the right side surface 10R of the apparatus main body 10 (FIG. 1) in an area opposite to the downstream side of the manual sheet feeding tray 46A in the sheet conveying direction. The loading section 10A corresponds to a part of the case of the apparatus main body 10. The loading section 10A is a generally rectangular parallelepiped-like housing extending in the front-back direction so as to have a predetermined width in the lateral direction. As shown in FIG. 4, the pair of fulcrum portions 701 of the manual sheet feeding tray 46A is rotatably supported by a pair of first fulcrum axial-support sections 10A1 of the loading section 10A. In FIG. 4, only the front first fulcrum axial-support section 10A1 is shown. Furthermore, the latching fulcrum portions 702A of the pair of latching sections 702 are similarly rotatably supported by a pair of second fulcrum axial-support sections 10A2 of the loading section 10A. In FIG. 4, only the rear second fulcrum axial-support section 10A2 is shown.

The loading section 10A includes a guide section 100. The guide section 100 is a wall portion disposed opposite the lifting plate 71 of the manual sheet feeding tray 46A. The guide section 100 is inclined upward toward the downstream side in the sheet conveying direction to define a part of the manual feeding sheet conveying path 460. The guide section 100 is disposed at a predetermined spacing from the lifting plate 71 in the sheet conveying direction. The guide section 100 guides a sheet conveyed by the sheet feeding roller 461

(FIG. 1) in a direction intersecting with the lifting plate 71 on the sectional view intersecting with the sheet width direction (the direction of arrow DB in FIG. 4 or the direction toward the upper left of FIG. 4).

The guide section 100 includes a guide pad 101, an inner cutout portion 102, and an outer cutout portion 103.

The guide pad 101 is disposed in a central portion in the sheet width direction (front-back direction), of the guide section 100. The guide pad 101 consists of a rubber member similarly to the sheet feeding pad 710. The guide pad 101 forms a conveying nip portion between the guide pad 101 and a peripheral surface of the sheet feeding roller 461. The sheet feeding roller 461 is disposed on a downstream side of the manual sheet feeding tray 46A in the sheet conveying direction opposite a central portion, in the sheet width direction, of the manual sheet feeding tray 46A. That is, the sheet feeding roller 461 is disposed opposite an area where the sheet feeding pad 710 crosses the guide pad 101. The peripheral surface of the sheet feeding roller 461 forms a sheet feeding nip portion and the conveying nip portion between the peripheral surface and each of the sheet feeding pad 710 and the guide pad 101, thereby allowing the sheet to be conveyed in a sheet guide direction (the direction of arrow DB) along the guide section 100 from the sheet conveyance direction (direction indicated by arrow DA) in FIG. 4.

The inner cutout portions 102 are a pair of cutout portions disposed in a part of the guide section 100 located outside the guide pad 101 in the front-back direction. The inner cutout portions 102 are arranged opposite the respective guide pieces 711 of the lifting plate 71. The inner guide pieces 711 are arranged so as to enter the respective inner cutout portions 102. Similarly, the outer cutout portions 103 are a pair of cutout portions disposed in a part of the guide section 100 located outside the inner cutout portions 102 in the front-back direction. In other words, the outer cutout portions 103 are arranged at respective opposite ends of the guide section 100 in the front-back direction. The outer cutout portions 103 are arranged opposite the respective outer guide pieces 712 of the lifting plate 71. The outer guide pieces 712 are arranged to enter the respective outer cutout portions 103.

In other words, the inner guide pieces 711 and outer guide pieces 712 of the lifting plate 71 are a plurality of projecting pieces arranged along the sheet width direction so as to project toward the guide section 100 from an edge portion of the lifting plate 71 located opposite the guide section 100. The inner guide pieces 711 and the outer guide pieces 712 are arranged to enter the inner cutout portions 102 and outer cutout portions 103 of the guide section 100, respectively, to allow comb shapes of the guide section 100 and the lifting plate 71 mesh with each other with a gap between the comb shapes. Thus, delivery of the sheet from the lifting plate 71 to the guide section 100 is suitably realized.

As shown in FIG. 2 and FIG. 5, in the embodiment the lifting plate 71 rotationally moves around the lifting fulcrum portions 71C as a fulcrum to bring the sheet into abutting contact with the sheet feeding roller 461. At this time, the lifting fulcrum portions 71C are axially supported by the tray main body 70, located upstream of the sheet feeding roller 461 in the conveying direction. This allows a rotating radius for rotational movement of the lifting plate 71 to be set larger than a case where the lifting fulcrum portions 71C of the lifting plate 71 are disposed on the apparatus main body 10 side similarly to the first fulcrum axial-support sections 10A1 of the loading section 10A. Thus, even with a change in the number of sheets placed on the lifting plate 71, the orientation of the sheets coming into abutting contact with the sheet feeding roller 461 is kept stable. As a result, regardless of the number of sheets placed on the manual sheet feeding tray 46A, the sheet is stably conveyed to the image forming section 30, and an image is suitably formed on the sheet.

FIG. 5 shows, at DL1, an orientation of a sheet placed on the loading surface of the manual sheet feeding tray 46A where the sheet is pushed up by the lifting plate 71 and comes into abutting contact with the sheet feeding roller 461. On the other hand, FIG. 5 shows, at DL2, an orientation of the uppermost sheet of sheets placed at full loading capacity on the loading surface of the manual sheet feeding tray 46A where the uppermost sheet is pushed up by the lifting plate 71 and comes into abutting contact with the sheet feeding roller 461. As described above, if the lifting fulcrum portions 71C of the lifting plate 71 are disposed on the apparatus main body 10 side similarly to the first fulcrum axial-support sections 10A1 of the loading section 10A, there is an increase in a difference in orientation between DL1 and DL2 in FIG. 5, that is, a difference in angle at which the sheets come into abutting contact with the sheet feeding roller 461, leading to unstable sheet conveying performance. In particular, when the lifting fulcrum portions 71C are disposed on the apparatus main body 10 side, the rotating radius for the rotational movement of the lifting plate 71 decreases, and the orientation DL1 in FIG. 5 is inclined left up. On the other hand, according to the present embodiment, the lifting fulcrum portions 71C of the lifting plate 71 are disposed upstream of the right side surface 10R in the conveying direction as shown in FIG. 5. The right side surface 10R is disposed upstream of the sheet feeding roller 461 in the conveying direction. This allows the rotating radius for the rotational movement of the lifting plate 71 to be set larger.

Moreover, as described above, the lifting fulcrum portions 71C of the lifting plate 71 are disposed on the same axis as the axis of the slide fulcrum portions 702B of the latching section 702. Thus, the lifting fulcrum portions 71C of the lifting plate 71 can be placed utilizing the position of the axis of the slide fulcrum portions 702B of the latching section 702, which axis is used for the rotational movement of the tray main body 70. This enables smooth realization of the opening and closing operations of the manual sheet feeding tray 46A and slidable movement of the lifting plate 71 described below.

Figure 8:
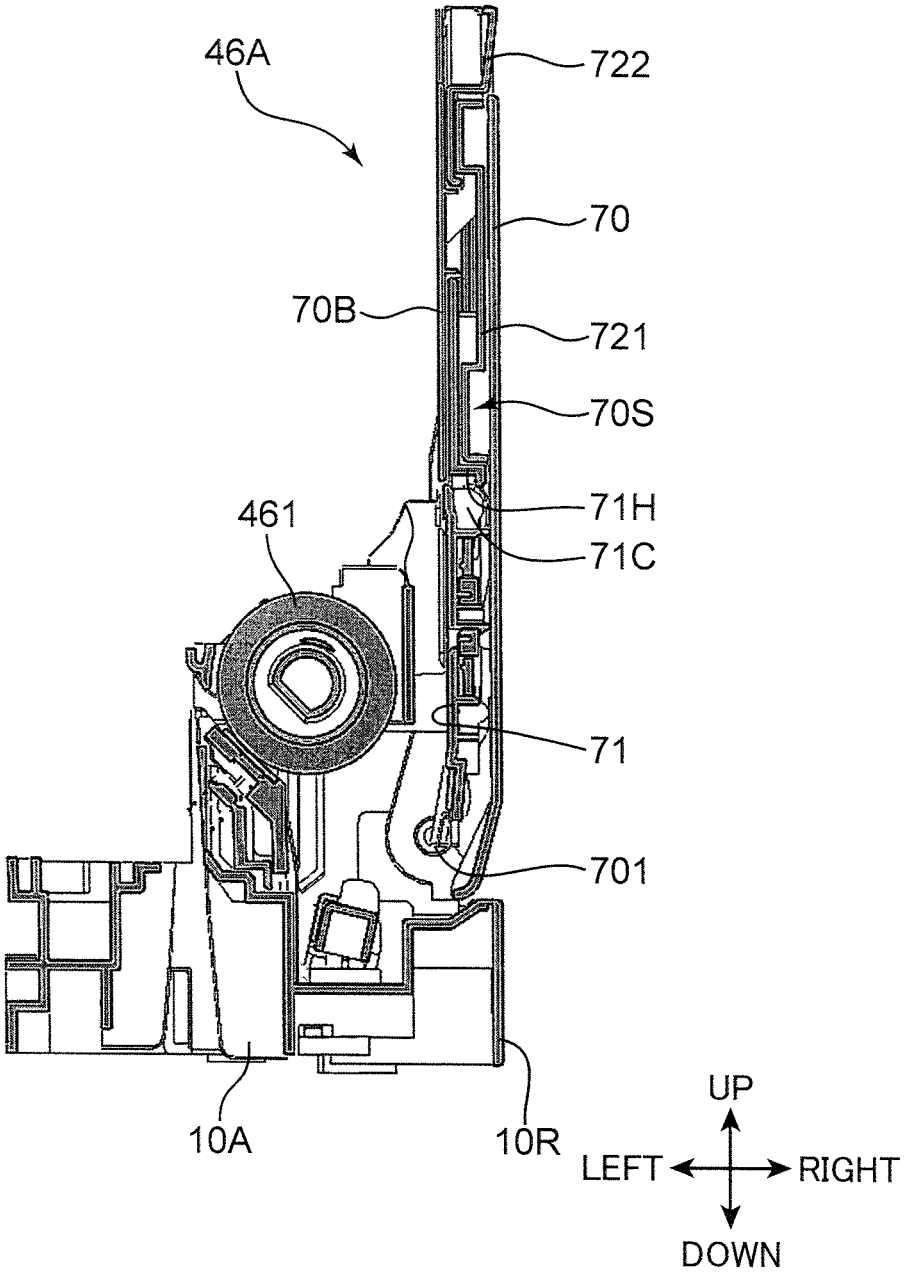
FIG. 8 is a cross-sectional view showing that the manual sheet feeding tray of the manual sheet feeding section according to the embodiment of the disclosure is being opened.

Now, the opening and closing operations of the manual sheet feeding tray 46A according to the present embodiment will be described in detail with reference to FIG. 8 to FIG. 11 in addition to FIG. 1 to FIG. 7. FIG. 8 to FIG. 11 are cross-sectional views sequentially showing that the manual sheet feeding tray 46A is opened with respect to the right side surface 10R of the apparatus main body 10. FIG. 8 shows a state where the manual sheet feeding tray 46A is closed with respect to the right side surface 10R. Furthermore, the state changes sequentially from FIG. 8 to FIG. 11, and then, the manual sheet feeding tray 46A reaches the state in FIG. 5, where the manual sheet feeding tray 46A is completely open with respect to the right side surface 10R.

As shown in FIG. 8, in the closed state of the manual sheet feeding tray 46A, the manual sheet feeding tray 46A faces the right side surface 10R of the apparatus main body 10. In this case, on the left side of the manual sheet feeding tray 46A, that is, on the loading surface side of the manual sheet feeding tray 46A, a part of the tray upper surface portion 70B is placed so as to overlap the lifting plate 71. In the housing space 70S, formed inside the tray main body 70 to the right of the tray upper surface portion 70B, the intermediate plate 71H and the first auxiliary tray 721 are housed so as to overlap each other in the lateral direction. Furthermore, each of the slide fulcrum portions 702B of the latching section 702 is placed on an upper end side (not shown in the drawings) of the corresponding guide groove 703.

Figure 9:
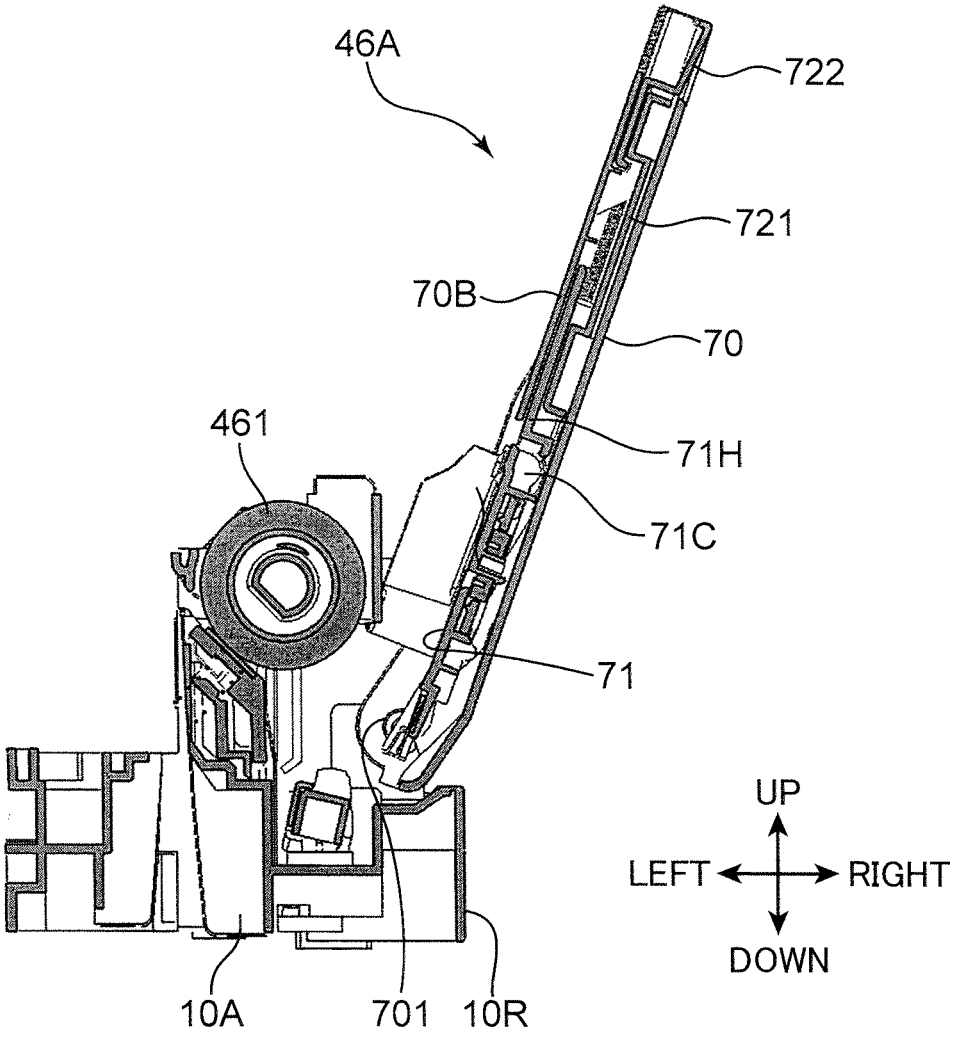
FIG. 9 is a cross-sectional view showing that the manual sheet feeding tray of the manual sheet feeding section according to the embodiment of the disclosure is being opened.
Figure 10:
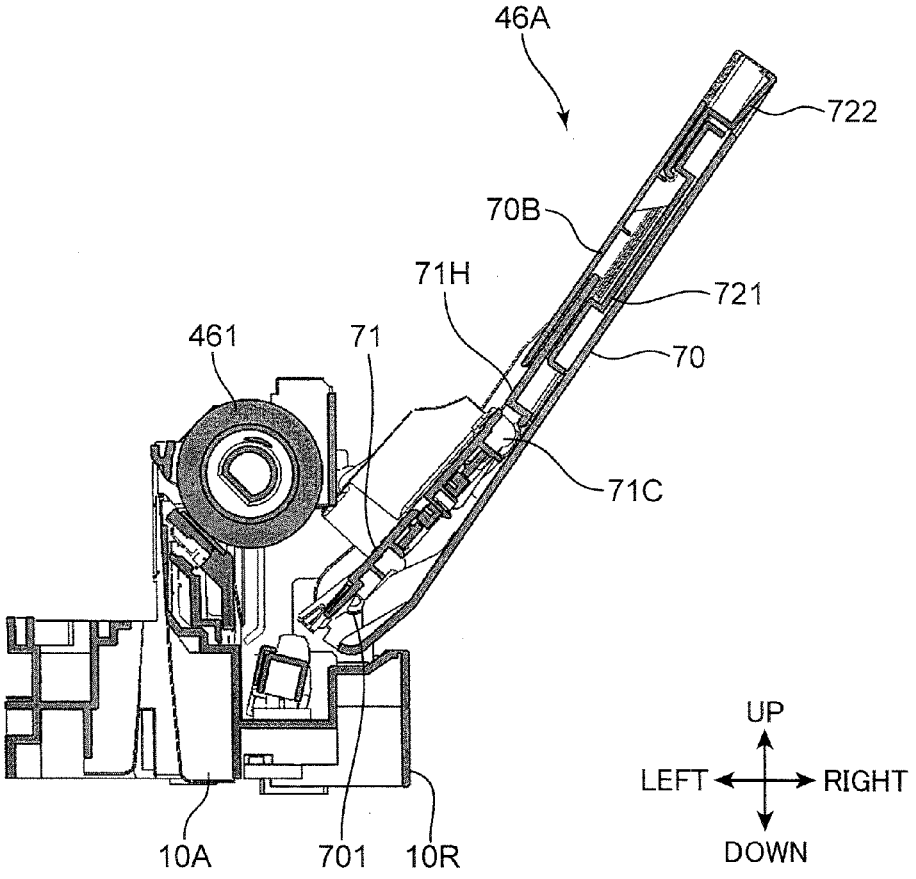
FIG. 10 is a cross-sectional view showing that the manual sheet feeding tray of the manual sheet feeding section according to the embodiment of the disclosure is being opened.
Figure 11:
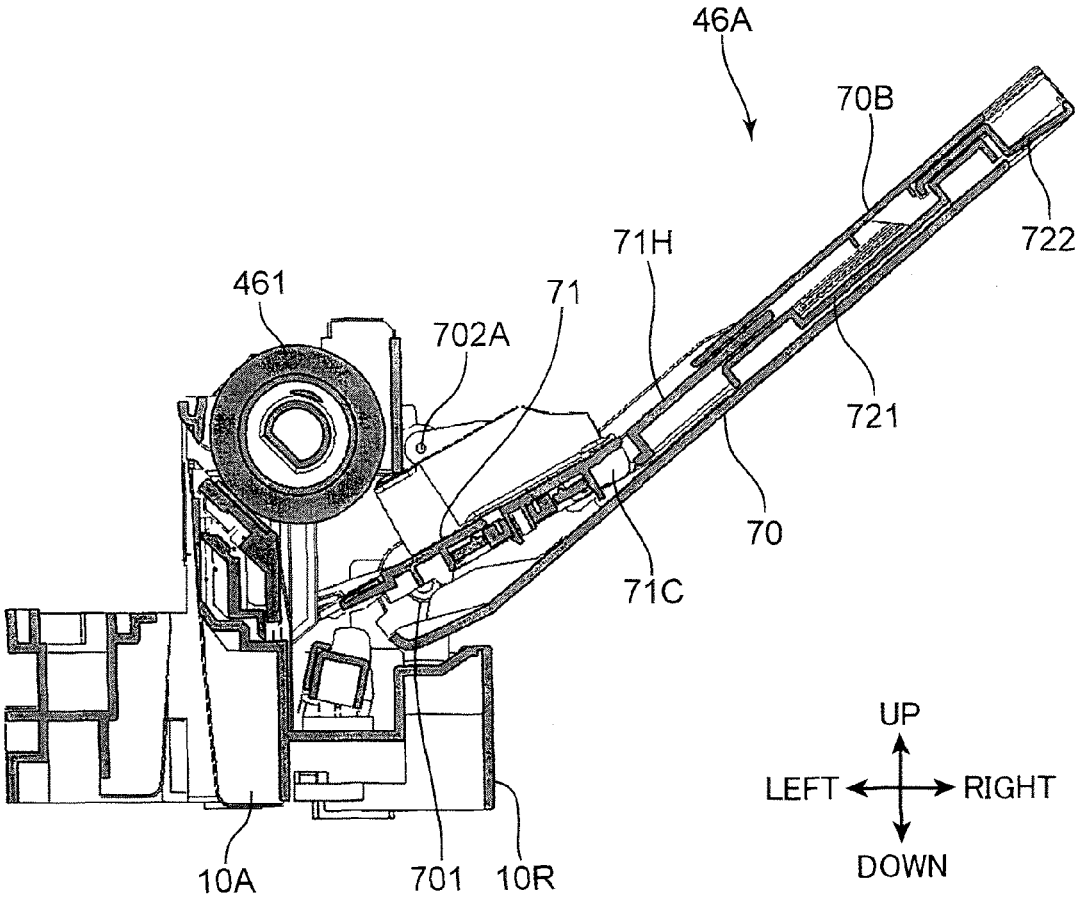
FIG. 11 is a cross-sectional view showing that the manual sheet feeding tray of the manual sheet feeding section according to the embodiment of the disclosure is being opened.

In the state in FIG. 8, when the user of the image forming apparatus 1 starts to open the manual sheet feeding tray 46A, an upper end side of the manual sheet feeding tray 46A moves rotationally clockwise around the fulcrum portion 701 as a fulcrum as shown in FIG. 9 to FIG. 11. At this time, the latching section 702 (FIG. 2) moves rotationally around the latching fulcrum portions 702A as a fulcrum. The slide fulcrum portions 702B of the latching section 702 move downward (to the downstream side in the sheet conveying direction) along the guide grooves 703. As a result, the tray upper surface portion 70B moves to the upstream side, in the conveying direction, of the lifting plate 71 and is placed on the upstream side. On the other hand, the lifting plate 71 including the lifting fulcrum portions 71C moves downward along the guide grooves 703 (from the upstream side in the conveying direction to the downstream side in the conveying direction) in a slidable manner, in conjunction with the opening operation of the manual sheet feeding tray 46A with respect to the apparatus main body 10. At this time, the lifting plate 71 moves downstream in the sheet conveying direction while being separated from the tray upper surface portion 70B. Then, in conjunction with the slidable movement, the downstream side end portion, in the conveying direction, of the lifting plate 71, where the sheet feeding pad 710 is disposed, enters the internal space in the apparatus main body 10 so as to be placed below the sheet feeding roller 461 while the manual sheet feeding tray 46A is being opened, as shown in FIG. 1 and FIG. 5. As a result, the manual sheet feeding tray 46A is opened to a predetermined angle to the right side surface 10R, allowing sheets to be placed on the loading surface of the manual sheet feeding tray 46A.

As described above, the lifting plate 71 moves downstream in the conveying direction in a slidable manner in conjunction with the opening operation of the manual sheet feeding tray 46A, according to the preset embodiment. This allows the loading surface of the manual sheet feeding tray 46A to be extended in the conveying direction. Moreover, the downstream side end portion, in the conveying direction, of the lifting plate 71 is placed below the sheet feeding roller 461 in conjunction with the slidable movement. This allows the lifting plate 71 to come into stable abutting contact with the sheet feeding roller 461 from below. Furthermore, the lifting plate 71 moves so as to spread the sheet loading surface in conjunction with the opening operation of the manual sheet feeding tray 46A. This inhibits the leading end portion of the lifting plate 71 from colliding against a part of the right side surface 10R. In other words, when the lifting plate 71 is fixed so as to always extend downstream in the conveying direction beyond the fulcrum portion 701, the leading end portion of the lifting plate 71 interferes with a part of the loading section 10A located below the fulcrum portion 701 in conjunction with the rotational movement of the manual sheet feeding tray 46A.

According to the present embodiment, the tray upper surface portion 70B of the manual sheet feeding tray 46A is inclined downward toward the downstream side in the conveying direction as shown in FIG. 5. Since the tray upper surface portion 70B is inclined the leading end side down, the leading edge of sheets placed on the loading surface of the manual sheet feeding tray 46A is stably aligned below the sheet feeding roller 461. On the other hand, a part of the manual feeding sheet conveying path 460 located downstream of the sheet feeding roller 461 in the conveying direction is inclined upward toward the downstream side in the conveying direction as shown in FIG. 1. Consequently, the sheets placed on the manual sheet feeding tray 46A are changed from an orientation with the leading end side down to an orientation with the leading end side up. Even in this case, according to the present embodiment, the lifting plate 71, which moves rotationally around the lifting fulcrum portions 71C as a fulcrum, has a gentler slope than the tray upper surface portion 70B toward the downstream side in the conveying direction, allowing the sheet to be guided toward the guide section 100 along the slope, as shown in FIG. 5. Therefore, the sheet is stably loaded from the loading surface with the leading end side down onto the sheet conveying path 460 with the leading end side up. Furthermore, the leading end portion of the sheet is prevented from being buckled as a result of a violent collision against the loading section 10A.

Moreover, according to the present embodiment, the intermediate plate 71H housed in the housing space 70S is withdrawn from the housing space 70S to the lifting plate 71 side (to the downstream side in the sheet conveying direction) in conjunction with the slidable movement of the lifting plate 71 interlocked with the opening operation of the manual sheet feeding tray 46A shown from FIG. 8 to FIG. 11 and FIG. 5. Specifically, as described above, the intermediate plate 71H is pressed under its own weight to come into abutting contact with the upper end portion of the lifting plate 71. Thus, when the lifting plate 71 moves downstream in the conveying direction in a slidable manner so as to be separated from the tray upper surface portion 70B, the intermediate plate 71H, which is in abutting contact with the upper end portion of the lifting plate 71, moves downstream in the conveying direction so as to follow the slidable movement of the lifting plate 71 and is withdrawn from the housing space 70S. As a result, the intermediate plate 71H forms a part of the loading surface of the manual sheet feeding tray 46A between the lifting plate 71 and the tray upper surface portion 70B as shown in FIG. 2 and FIG. 5. Consequently, even when the lifting plate 71 moves in a slidable manner, the loading surface between the tray upper surface portion 70B and the lifting plate 71 is inhibited from being lost. As a result, the sheets are stably supported on the loading surface along the conveying direction. Furthermore, as described above, the intermediate plate 71H comes into abutting contact with the lifting plate 71 under the weight of the intermediate plate 71H and moves in a slidable manner along with the lifting plate 71. Thus, the operation of withdrawing the intermediate plate 71H from the housing space 70S is easily realized without the need for a dedicated driving mechanism for the intermediate plate 71H.

An operation reverse to the operation of withdrawing the intermediate plate 71H switches the manual sheet feeding tray 46A from the open state shown in FIG. 2 and FIG. 5 to the close state shown in FIG. 8. That is, the user of the image forming apparatus 1 grips the gripping section 722A (FIG. 2) and rotationally moves a right end portion of the manual sheet feeding tray 46A counterclockwise. At this time, the slide fulcrum portion 702B is moved from the left end portion to a right end portion (the upper end portion after rotational movement) of the guide groove 703. When the lifting plate 71 is moved upstream in the conveying direction along the guide grooves 703, the intermediate plate 71H is pushed up by the lifting plate 71 and housed inside the housing space 70S again.

Description has been given which relates to the manual sheet feeding section 46 (manual sheet feeding tray 46A) and the image forming apparatus 1 including the manual sheet feeding section 46 according to the embodiment of the disclosure. However, the disclosure is not limited to this configuration, and for example, the following variations may be adopted.

(1) According to the embodiment, the slide fulcrum portions 702B, which serve as a fulcrum on the sidewalls 70A of the latching section 702, are disposed on the same axis as the axis of the lifting fulcrum portions 71C, which serve as a fulcrum for the rotational movement of the lifting plate 71. However, the disclosure is not limited to this configuration. The two fulcrums may be arranged at different positions on the latching section 702.

(2) In the description of the embodiment, the lifting fulcrum portion 71C is disposed outside the right side surface 10R (upstream of the right side surface 10R in the conveying direction). However, the disclosure is not limited to this configuration. The right side surface 10R may be disposed so as to project toward the manual sheet feeding tray 46A, whereas the lifting fulcrum portion 71C (slide fulcrum portion 702B) may be disposed inside the right side surface 10R.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A sheet feeding apparatus arranged to an apparatus main body that has a wall portion and a sheet conveying path, comprising:

a sheet tray that is installed on the wall portion and constitutes a loading surface on which a sheet to be conveyed in a predetermined conveying direction is placed;

a sheet feeding roller that is disposed opposite the loading surface on a downstream side of the sheet tray in the conveying direction, the sheet feeding roller being rotationally driven to feed the sheet to the sheet conveying path; and a pair of link members that have a first end portion and a second end portion each, the sheet tray includes:

a tray main body that includes the loading surface and that is openable and closable with respect to the wall portion; and a lifting plate having a pair of first fulcrum portions disposed upstream of the sheet feeding roller in the conveying direction at respective opposite end portions of the lifting plate in a sheet width direction intersecting with the conveying direction, the lifting plate having an upper surface constituting a downstream side, in the conveying direction, of the loading surface, and the downstream side of the lifting plate being rotationally movable up and down around the first fulcrum portions, thereby bringing the sheet into contact with the sheet feeding roller;

a pair of sidewalls erected at respective opposite ends of the tray main body in the sheet width direction; and a pair of slot-like openings formed in the respective sidewalls of the pair of sidewalls along the conveying direction, wherein the tray main body has a pair of second fulcrum portions disposed on a downstream side of the tray main body in the conveying direction at respective opposite ends of the tray main body in the sheet width direction, the second fulcrum portions being rotatably supported by the wall portion and being configured to be a pivot point for the opening and closing operation of the tray main body, wherein each of a pair of link members is coupled to the first fulcrum portion at the first end portion and to the wall portion at the second end portion, thereby regulating an opening angle of the tray main body around the second fulcrum portions the first end portion of the link member supports the first fulcrum portion via the opening in such a manner that the first fulcrum portion is rotatable, and the first end portion is slidably movable along the opening, and the tray main body is rotationally moved around the second fulcrum portions and the first end portion of the link member moves to the downstream side in the conveying direction along the opening to open the sheet tray to a predetermined angle to the wall portion and to allow the sheets to be placed on the loading surface, wherein the first fulcrum portions move from an upstream side to a downstream side in the conveying direction along the openings in a slidable manner in conjunction with the opening operation of the sheet tray with respect to the apparatus main body.

2. The sheet feeding apparatus according to claim 1, wherein the wall portion is disposed upstream of the sheet feeding roller in the conveying direction, and the first fulcrum portions of the lifting plate are disposed upstream of the wall portion in the conveying direction.

3. An image forming apparatus comprising:

an apparatus main body;

the sheet feeding apparatus according to claim 2; and an image forming section to which the sheet from the sheet feeding apparatus is conveyed and which forms an image on the sheet.

4. The sheet feeding apparatus according to claim 1, wherein, in conjunction with the slidable movement, a downstream side end portion, in the conveying direction, of the lifting plate enters an internal space in the apparatus main body so as to be placed below the sheet feeding roller while the sheet tray is in an open state.

5. The sheet feeding apparatus according to claim 4, wherein the apparatus main body includes a guide section disposed opposite the downstream side of the lifting plate in the conveying direction and inclined upward toward the downstream side in the conveying direction, the guide section defining a part of the sheet conveying path, and while the sheet tray is in an open state, the loading surface of the tray main body is tilted downward toward the downstream side in the conveying direction, and the loading surface of the lifting plate has a gentler slope than the loading surface of the tray main body toward the downstream side in the conveying direction to allow the sheet to be guided to the guide section.

6. An image forming apparatus comprising:

an apparatus main body;

the sheet feeding apparatus according to claim 5; and an image forming section to which the sheet from the sheet feeding apparatus is conveyed and which forms an image on the sheet.

7. An image forming apparatus comprising:

an apparatus main body;

the sheet feeding apparatus according to claim 4; and an image forming section to which the sheet from the sheet feeding apparatus is conveyed and which forms an image on the sheet.

8. The sheet feeding apparatus according to claim 1, wherein the tray main body further includes:

a tray upper surface portion configured to form an upstream side of the loading surface, a housing portion formed inside the tray main body and defined by the tray upper surface portion; and an intermediate tray which is disposed between the tray upper surface portion and the lifting plate, wherein the intermediate tray is housed in the housing portion so as to overlap the tray upper surface portion when the sheet tray is in a closed state with respect to the apparatus main body and withdrawn from the housing portion to the downstream side in the conveying direction in conjunction with slidable movement of the lifting plate interlocked with the opening operation of the sheet tray, thereby forming a part of the loading surface between the lifting plate and the tray upper surface portion.

9. The sheet feeding apparatus according to claim 8, wherein a downstream-side end, in the conveying direction, of the intermediate tray is pressed under a weight of the intermediate tray to come into contact with the upstream-side end, in the conveying direction, of the lifting plate and is withdrawn from the housing portion so as to follow the slidable movement of the lifting plate.

10. An image forming apparatus comprising:

an apparatus main body;

the sheet feeding apparatus according to claim 9; and an image forming section to which the sheet from the sheet feeding apparatus is conveyed and which forms an image on the sheet.

11. An image forming apparatus comprising:

an apparatus main body;

the sheet feeding apparatus according to claim 8; and an image forming section to which the sheet from the sheet feeding apparatus is conveyed and which forms an image on the sheet.

12. An image forming apparatus comprising:

an apparatus main body;

the sheet feeding apparatus according to claim 1; and an image forming section to which the sheet from the sheet feeding apparatus is conveyed and which forms an image on the sheet.

* * * * *